US007094111B1

(12) United States Patent
Qingbiao

(10) Patent No.: US 7,094,111 B1
(45) Date of Patent: Aug. 22, 2006

(54) LAMP INCLUDING A REPLACEABLE LIGHT EMITTING DIODE (LED)

(75) Inventor: Wu Qingbiao, Fujian (CN)

(73) Assignee: Jinjiang Wandaihao Toys Co., Ltd., Fujian (CN)

( * ) Notice: Subject to any disclaimer, the term of this patent is extended or adjusted under 35 U.S.C. 154(b) by 0 days.

(21) Appl. No.: 11/251,556

(22) Filed: Oct. 14, 2005

(30) Foreign Application Priority Data

Aug. 19, 2005 (CN) ..... 200520074832

(51) Int. Cl.
*H01R 24/00* (2006.01)

(52) U.S. Cl. ..... 439/699.2; 362/653

(58) Field of Classification Search ..... 439/699.2, 439/619, 419, 605; 362/226, 652, 653, 654
See application file for complete search history.

(56) References Cited

U.S. PATENT DOCUMENTS 5,626,415 A * 5/1997 Huang ..... 362/650
6,183,310 B1 * 2/2001 Shu ..... 439/699.2
6,368,161 B1 * 4/2002 Lin ..... 439/699.2
6,595,657 B1 * 7/2003 Shieh ..... 362/653

* cited by examiner

*Primary Examiner*—Hae Moon Hyeon
(74) *Attorney, Agent, or Firm*—Michael J. Wise; Perkins Coie LLP

(57) ABSTRACT

A lamp includes a lamp cover, a light emitting diode (LED), and a lamp holder. The lamp holder includes a lamp seat, an inner cover, and an outer cover. An annular groove into which a head of the lamp cover is mounted is provided in the lamp seat. The inner cover, formed by a permanent portion and a movable portion firmly combined or attached to each other, includes two or more channels running longitudinally through its hollow interior body in communication with two or more openings or through holes extending through the lamp seat. Legs of the LED pass through the through holes and extend into the longitudinal channels of the inner cover to make an electrical engagement with lead wires projecting upwardly from the bottom end of the longitudinal channels. The inner cover is completely inserted into the outer cover.

6 Claims, 3 Drawing Sheets

LAMP INCLUDING A REPLACEABLE LIGHT EMITTING DIODE (LED)

CROSS-REFERENCE TO RELATED APPLICATION

The present application claims priority to Chinese Patent Application No. 200520074832.4, filed Aug. 19, 2005, the disclosure of which is incorporated by reference herein in its entirety, including drawings.

FIELD OF THE INVENTION

The present invention is directed to a lamp, and more particularly to a lamp including a light emitting diode (LED) as the lighting source.

BACKGROUND

Lamps with an LED light source typically include a lamp cover, the LED, and a lamp holder. The LED is positioned inside the lamp cover and has two legs extending out of a head of the lamp cover through attached lead wires. The lamp cover head is then put in a machine for injection, forming a lamp holder within which the lamp cover head and the lead wires are tightly enclosed. Producing a lamp in this manner is relatively difficult and complicated. Additionally, if the LED or the lamp cover breaks, a professional tool is generally required to split open the lamp holder and to replace the broken part. The lamp holder must then be injected again.

BRIEF SUMMARY

A lamp including an LED light source is configured such that it is easy to assemble and to repair. The lamp includes a lamp cover, an LED, and a lamp holder. The lamp holder includes a lamp seat, an inner cover, and an outer cover, all preferably made of an insulating material. An annular groove into which the head of the lamp cover is mounted is provided in the lamp seat.

Two or more through holes are formed in the lamp seat in a longitudinal direction to provide openings through which legs on the LED pass. The inner cover preferably includes a permanent portion connected to a bottom edge of the lamp seat and a movable portion that may be combined with the permanent portion. Two or more longitudinal channels are formed within an internal space of the permanent portion and the movable portion. The longitudinal channels are positioned adjacent to, and isolated from, each other allowing the LED legs, which extend out of the lamp seat via through holes therein, to make an electrical engagement with lead wires projecting upwardly from the bottom end of the longitudinal channels. The inner cover and the embedded lead wires are inserted into the outer cover.

The internal space of the permanent portion includes an insulation projection that separates the internal space of the permanent portion into two longitudinal channels. Each of the longitudinal channels is in communication with one of the respective through holes of the lamp seat. The internal space of the movable portion is recessed with a groove extending longitudinally along the internal space of the movable portion for receiving the insulation projection of the permanent portion.

A pair of directive blocks having an angle of inclination is provided at the upper end of each of the longitudinal channels of the permanent portion, with the directive blocks forming a space adjacent to the LED into two narrow slots. A pair of directive recesses with an oblique angle inclined toward the LED is provided in the internal space of the movable portion at a position corresponding to the directive blocks of the permanent portion.

Each of two or more conductive plates, each of which is connected to an end of one of the lead wires, is held in intimate engagement with a respective LED leg extending out of the corresponding through hole at the narrow slot.

A pair of convex flanges is formed at the lower end of each of the longitudinal channels of the permanent portion. A convex flange is formed on each of the longitudinal channels of the movable portion at a position correspondingly central to the pair of convex flanges of each of the longitudinal channels of the permanent portion.

A corner adjacent to the insulation projection of the permanent portion includes a positioning pin, and the movable portion includes a positioning hole at a corresponding position for engagement with the positioning pin of the permanent portion.

One method of assembling the LED lamp includes positioning each of the conductive plates into a respective narrow slot of the permanent portion. The permanent portion is then attached to or otherwise combined with the movable portion to complete an inner cover. The inner cover is then positioned within the outer cover, and the two legs of the LED are inserted through the through holes of the lamp seat into the longitudinal channels of the inner cover.

The directive blocks at the upper end of the longitudinal channels guide the LED legs toward a respective narrow slot so that they make contact with a respective conductive plate. The lamp cover head is then mounted to the annular groove formed in the top of the lamp seat.

The described lamp configuration provides several benefits. For example, if a lamp cover is broken, a repair can be made by pulling the lamp cover out of the annular groove and replacing it with a new lamp cover. If an LED is broken, a repair can be made by pulling out the lamp cover and the broken LED from the lamp seat and replacing the LED with a new LED. If a conductive plate has a failure contact with the LED leg, a repair can be made by pulling the inner cover out of the outer cover and removing the movable portion. All of these repairs are convenient and may be made without damaging any portion of the LED lamp.

Other features and advantages of the invention will appear hereinafter. The features of the invention described above can be used separately or together, or in various combinations of one or more of them. The invention resides as well in sub-combinations of the features described. Furthermore, many of the method steps described herein may be performed in a different order than that which is explicitly described.

DETAILED DESCRIPTION OF THE INVENTION

Figure 1:
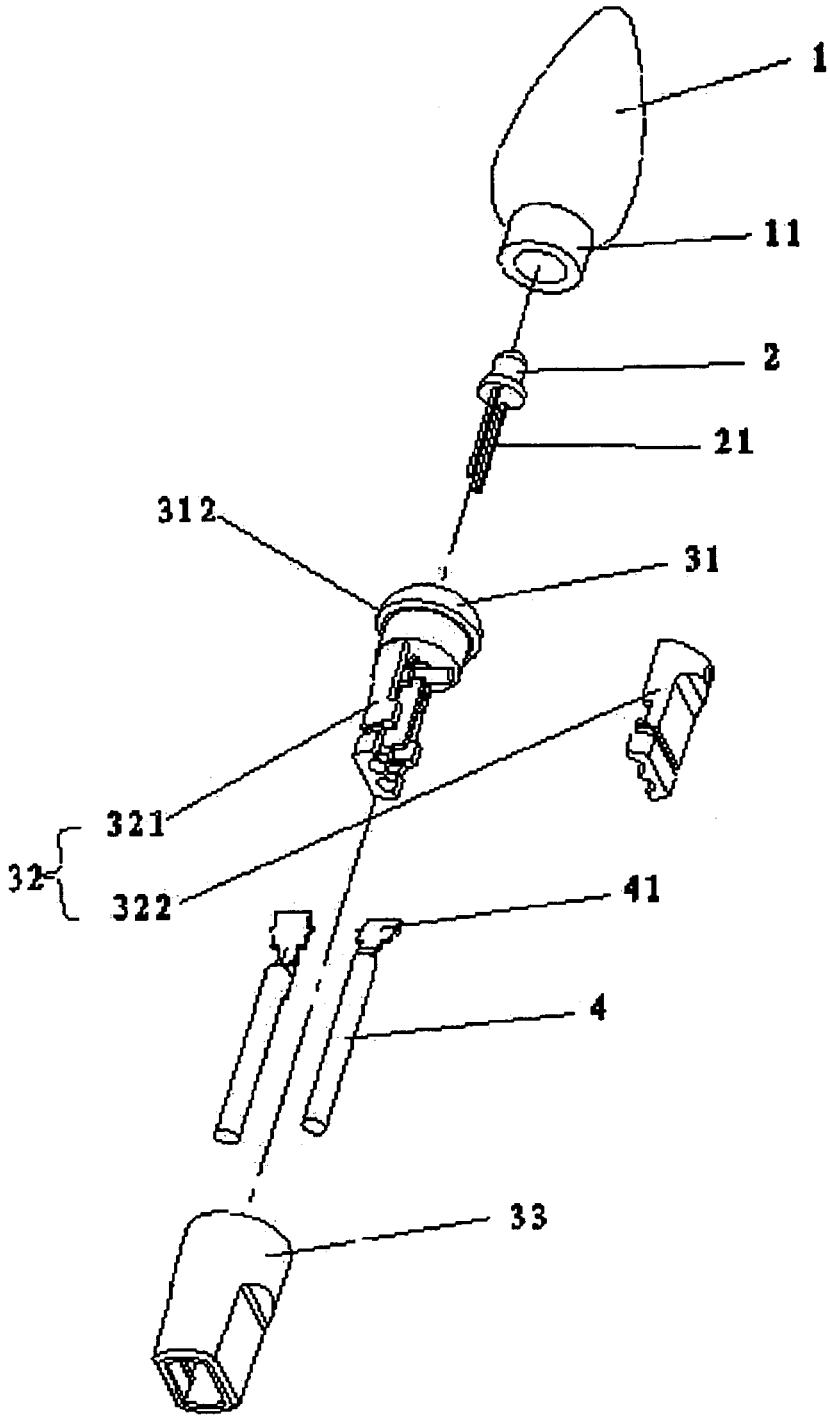
FIG. 1 is a fragmentary, sectioned, perspective view of an LED lamp according to one embodiment.
Figure 2:
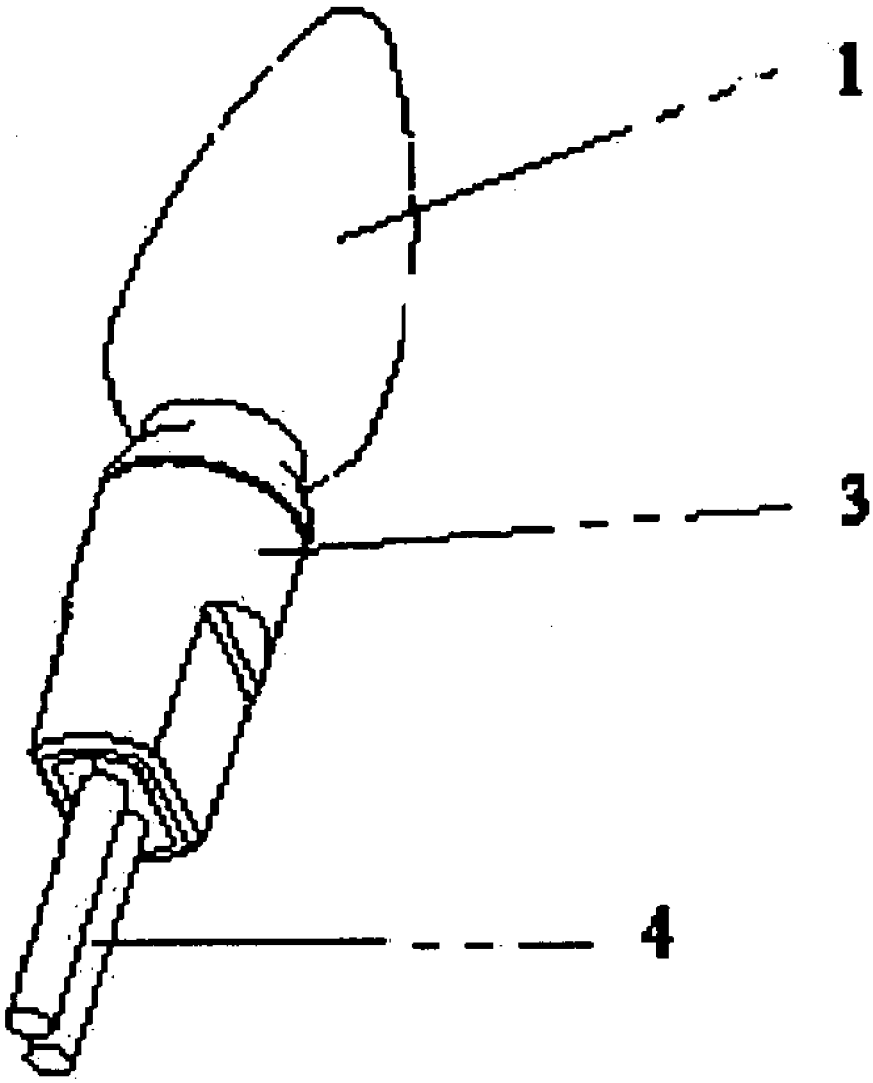
FIG. 2 is an assembled perspective view of the LED lamp illustrated in FIG. 1.

Referring to FIGS. 1 and 2, an LED lamp includes a lamp cover 1, a light emitting diode (LED) 2, and a lamp holder 3. The lamp holder 3 includes a lamp seat 31, an inner cover 32, and an outer cover 33.

Figure 3:
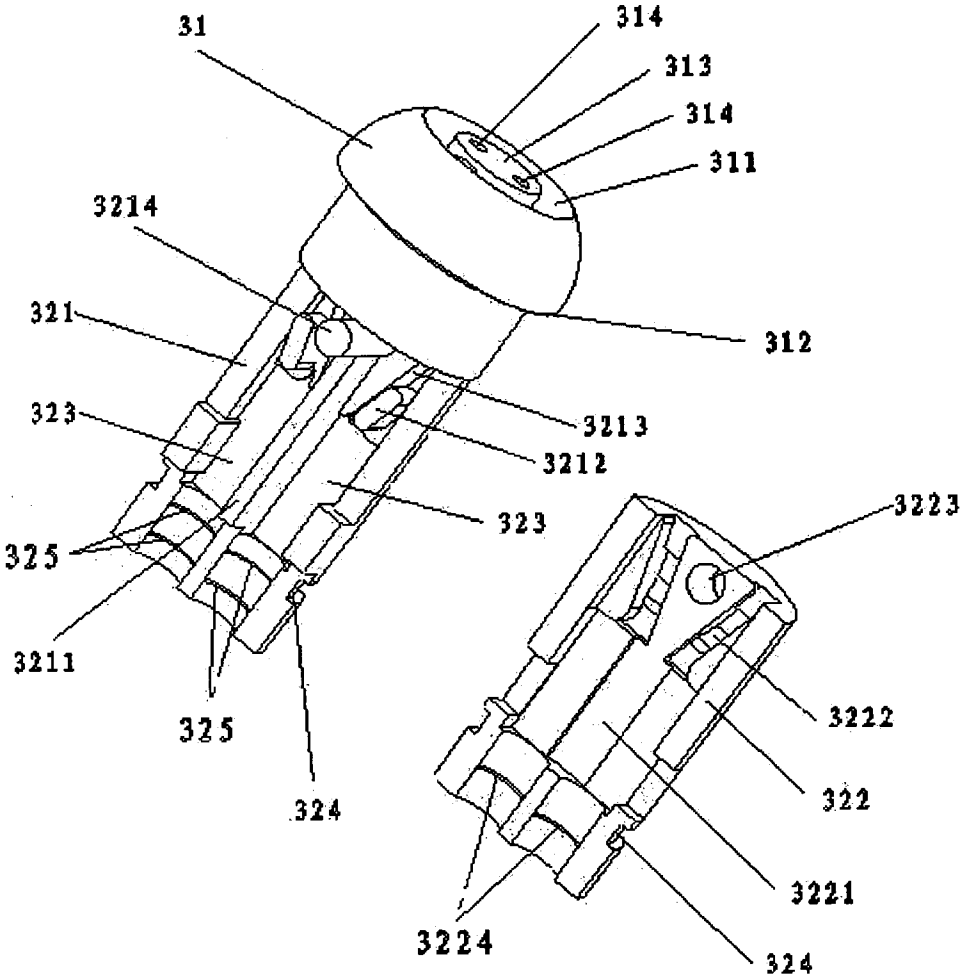
FIG. 3 is a perspective view of a lamp seat and an inner cover of the LED lamp illustrated in FIG. 1.

Referring to FIG. 3, an annular groove 311 into which a lamp cover head 11 may be mounted is provided in the lamp seat 31. Departing from the central position of the lamp seat 31 in a longitudinal direction is a positioning flange 312. The interior of the lamp seat 31 includes a cylindrical body having two or more openings through holes 314 extending longitudinally through the lamp seat 31.

A plastic-sealed portion of the LED 2 is positioned inside the lamp cover 1 with the base of the LED seating against the top surface of the cylindrical body 313. The LED legs 21 extend out of the lamp cover 1 into and through respective through holes 314.

The inner cover 32 includes a permanent portion 321 connected to the bottom edge of the lamp seat 31, and a movable portion 322 for attachment to or combination with the permanent portion 321. The internal space of the permanent portion 321 includes an insulation projection 3211 that separates the interior of the permanent portion 321 into two longitudinal channels 323. Each of the two longitudinal channels 323 of the permanent portion 321 is in communication with a respective opening or through hole 314 in the lamp seat 31. The internal space of the movable portion 322 is recessed with a groove 3221 for receiving the insulation projection 3211 of the permanent portion 321.

A directive block 3212 having an angle of inclination is provided at the upper end of each of the longitudinal channels 323 of the permanent portion 321 for shaping the space adjacent to the LED 2 into a narrow slot 3213. Directive recesses 3222, each having an oblique angle inclined toward the LED 2, are provided in the internal space of the movable portion 322 at positions corresponding to the directive blocks 3212 of the permanent portion 321. A positioning pin 3214 is formed adjacent to the insulation projection 3211 and is adapted for fitting into a positioning hole 3223 in the movable portion 322.

Two or more conductive plates 41 are connected to the ends of two or more corresponding lead wires 4. Each of the conductive plates 41 is held in intimate engagement with a respective LED leg 21 extending through an opening 314 into a narrow slot 3213 in the permanent portion 321.

Two convex flanges 325 are formed at the lower end of each of the longitudinal channels 323 of the permanent portion 321. Convex flanges 3224 are formed in the internal space of the movable portion 322, with each convex flange 3224 corresponding to a central portion located between a pair of the convex flanges 325 in one of the longitudinal channels 323. When the permanent portion 321 and the movable portion 322 are attached to or otherwise combined with each other, each pair of convex flanges 325 associated with a convex flange 3224 tightly holds a lead wire 4 within a longitudinal channel 323 to eliminate stress forces between the lead wires 4 and the conductive plates 41. Securing the lead wires 4 in the longitudinal channels 323 in this manner provides a secure engagement between the conductive plates 41 of the lead wires 4 and the LED legs 21.

A groove 324 is formed in the outer wall surface of the inner cover 32, and a convex flange is formed at the same position of the inner wall surface of the outer cover 33 for engagement with the groove 324. Combining the groove 324 with the convex flange enables the outer cover 33 to firmly enclose the inner cover 32 with its top edge bearing against the positioning flange 312 of the lamp seat 31.

One method of assembling the LED lamp includes positioning the conductive plates 41 of the lead wires 4 into the narrow slots 3213, and fitting the positioning pin 3214 into the positioning hole 3223 to form the inner cover 32 (which includes the permanent portion 321 and the movable portion 322). The inner cover 32 is then inserted into the outer cover 33 to complete the assembly of the lamp holder 3. Next, the two legs 21 of the LED 2 are inserted simultaneously into respective through holes 314 of the lamp seat 31 until the plastic-sealed portions of the LED 2 seat stably against the top surface of the lamp seat 31. The LED legs 2 exit the lamp seat 31 via through holes 314 for engagement with the corresponding conductive plates 41 at the narrow slots 3213 of the permanent portion 32. The lamp cover head 11 is then mounted in the annular groove 311 of the lamp seat 31.

If the LED lamp cover is broken, a repair can be made by pulling the lamp cover out of the ring-shaped groove and replacing it with a new lamp cover. If an LED is broken or otherwise inoperable, a repair can be made by pulling the lamp cover out of the ring-shaped groove, and pulling the bad LED from the lamp seat and replacing it with a new LED. If a conductive plate has a failure contact with the LED leg, a repair can be made by pulling the inner cover out of the outer cover, and removing the movable part. All of this repair work can be conveniently performed without damaging any section of the LED lamp.

Thus, while several embodiments have been shown and described, various changes and substitutions may of course be made, without departing from the spirit and scope of the invention. Many of the method steps described herein, for example, may be performed in a different order than that which is specifically described. The invention, therefore, should not be limited, except by the following claims and their equivalents.

What is claimed is:

1. A lamp, comprising:

a lamp cover including a lamp cover head;

an LED including a plurality of legs;

a lamp holder, comprising:

a lamp seat made of an insulating material and including an annular groove in which the lamp cover head is mounted, with a plurality of openings formed through the lamp seat in a longitudinal direction, and with the LED legs passing through the openings;

an outer cover made of an insulating material;

an inner cover made of an insulating material comprising;

a permanent portion connected to a bottom edge of the lamp seat;

a movable portion removably attached to the permanent portion;

wherein a plurality of longitudinal channels is provided in an internal space of the permanent portion and the movable portion, with the longitudinal channels positioned adjacent to and isolated in relation to one another for receiving the LED legs extending out of the lamp seat via the openings, wherein the LED legs are in electrical engagement with lead wires projecting upwardly from a bottom end of the longitudinal channels, and with the inner cover and the lead wires inserted into the outer cover.

2. The lamp according to claim 1, wherein the internal space of the permanent portion includes an insulation projection separating the internal space of the permanent portion into the longitudinal channels, with each of the longitudinal channels in communication with one of the openings in the lamp seat, and wherein the internal space of the movable portion is recessed with a groove extending longitudinally along the internal space of the movable portion to receive the insulation projection.

3. The lamp according to claim 2 further comprising:

a directive block, inclined at an angle, formed at an upper end of each of the longitudinal channels of the permanent portion, with the directive blocks shaping a space adjacent to the LED into a pair of narrow slots; and a pair of directive recesses, inclined at an oblique angle toward the LED, formed in the internal space of the movable portion at a position corresponding to the directive blocks of the permanent portion.

4. The lamp according to claim 3 further comprising a conductive plate at an end of each one of the lead wires, wherein each conductive plate is in engagement with a respective LED leg extending through one of the openings into one of the narrow slots.

5. The lamp according to claim 4 further comprising:

a pair of convex flanges formed at a lower end of each of the longitudinal channels of the permanent portion; and a corresponding convex flange formed at each of the longitudinal channels of the movable portion, with each corresponding convex flange at a position correspondingly central to one of the pairs of convex flanges in the permanent portion.

6. The lamp according to claim 5 further comprising a positioning pin located at a corner adjoining the insulation projection of the permanent portion, wherein the movable portion includes a positioning hole at a corresponding position for engagement with the positioning pin.

* * * * *